US012538972B2

(12) United States Patent
Lee et al.

(10) Patent No.: US 12,538,972 B2
(45) Date of Patent: Feb. 3, 2026

(54) PREDICTIVE APPLICATION FOR AI-POWERED DISPENSING DEVICE FOR HAIR TREATMENT

(71) Applicant: L'Oreal, Paris (FR)

(72) Inventors: Ji Lee, New York, NY (US); Mohamed Kanji, Clark, NJ (US)

(73) Assignee: L'Oreal, Paris (FR)

( * ) Notice: Subject to any disclaimer, the term of this patent is extended or adjusted under 35 U.S.C. 154(b) by 654 days.

(21) Appl. No.: 18/146,319

(22) Filed: Dec. 23, 2022

(65) Prior Publication Data

US 2023/0210245 A1 Jul. 6, 2023

Related U.S. Application Data

(60) Provisional application No. 63/295,313, filed on Dec. 30, 2021.

(30) Foreign Application Priority Data

Mar. 30, 2022 (FR) ..... 2202878

(51) Int. Cl.
*A45D 44/00* (2006.01)
*A45D 34/00* (2006.01)
*A45D 34/04* (2006.01)

(52) U.S. Cl.
CPC ..... *A45D 44/005* (2013.01); *A45D 34/04* (2013.01); *A45D 2034/005* (2013.01); *A45D 2044/007* (2013.01)

(58) Field of Classification Search
CPC ..... G06Q 50/01; A45D 44/005; A45D 19/00; A45D 2044/007; A45D 34/04; A45D 2034/005
See application file for complete search history.

(56) References Cited

U.S. PATENT DOCUMENTS 11,478,063 B2 * 10/2022 Suwanto ..... B08B 3/08
2011/0301441 A1 12/2011 Bandic et al.
(Continued)

FOREIGN PATENT DOCUMENTS

FR 3106731 A1 8/2021

OTHER PUBLICATIONS

Search Report and Written Opinion mailed Nov. 2, 2022, issued in corresponding French Application No. FR2202878, filed Mar. 30, 2022, 8 pages.
(Continued)

*Primary Examiner* — Timothy R Waggoner
(74) *Attorney, Agent, or Firm* — CHRISTENSEN O'CONNOR JOHNSON KINDNESS PLLC

(57) ABSTRACT

A system for dispensing hair care formulations including a communication device that includes processing circuitry capable of taking a photo of a user's hair, uploading the photo into an application on a communication device, applying an algorithm to the photo to detect one or more hair features, sensing one or more environmental conditions with one or more sensors, and recommending a hair care treatment regimen of one or more hair care formulas based on the one or more hair features, and the one or more environmental conditions. The system also includes one or more cartridges containing one or more hair care formulas, and a dispensing device configured to dispense one or more hair care formulas from the one or more cartridges based on the hair care treatment regimen.

20 Claims, 11 Drawing Sheets

(56) References Cited

U.S. PATENT DOCUMENTS

| | | | | |
|---|---|---|---|---|
| 2015/0021356 | A1* | 1/2015 | Witchell | B01F 33/848 222/23 |
| 2021/0312678 | A1* | 10/2021 | Luo | G06N 20/00 |

OTHER PUBLICATIONS

Anonymous; "Regiement (CE) N° 1223/2009 Du Parlement Europeen Et Du Conseil"; Journal officiel de l'Union europeenne; Nov. 30, 2009; 1 page.

* cited by examiner

1200

| MONDAY | TUESDAY | WEDNESDAY | THURSDAY | FRIDAY | SATURDAY | SUNDAY |
|---|---|---|---|---|---|---|
| HAIR COLOR | COLOR PROTECTING SHAMPOO | | COLOR PROTECTING SHAMPOO | | | ROOT TOUCH UP |
| TONER | COLOR PREDICTING CONDITIONER | | HAIR MASK | | | |
| BLEACH | | | | | | |

FIG. 11

PREDICTIVE APPLICATION FOR AI-POWERED DISPENSING DEVICE FOR HAIR TREATMENT

CROSS-REFERENCES TO RELATED APPLICATIONS

The present application claims priority to and the benefit of U.S. Provisional Application No. 63/295,313, filed Dec. 30, 2021, and French Application No. 2202878, filed Mar. 30, 2022, the entire disclosures of which are hereby incorporated by reference herein in their entirety for all purposes.

SUMMARY

The following describes an application for recommending personalized hair care formulas and hair color for use at home that works with localized trends, social media, environmental factors, hair features, and a user photograph, and is communicatively coupled a specialized dispenser to dispense the recommended or desired hair care formulations and colors. In some embodiments, ingredients in the dispenser allow for hair care product to be instantly blended into a user's preferred end result and then conveniently transported.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein:

FIG. 11 is an example hair care regimen as prescribed by a hair care dispensing system, in accordance with the present technology.

DETAILED DESCRIPTION

Figure 1:
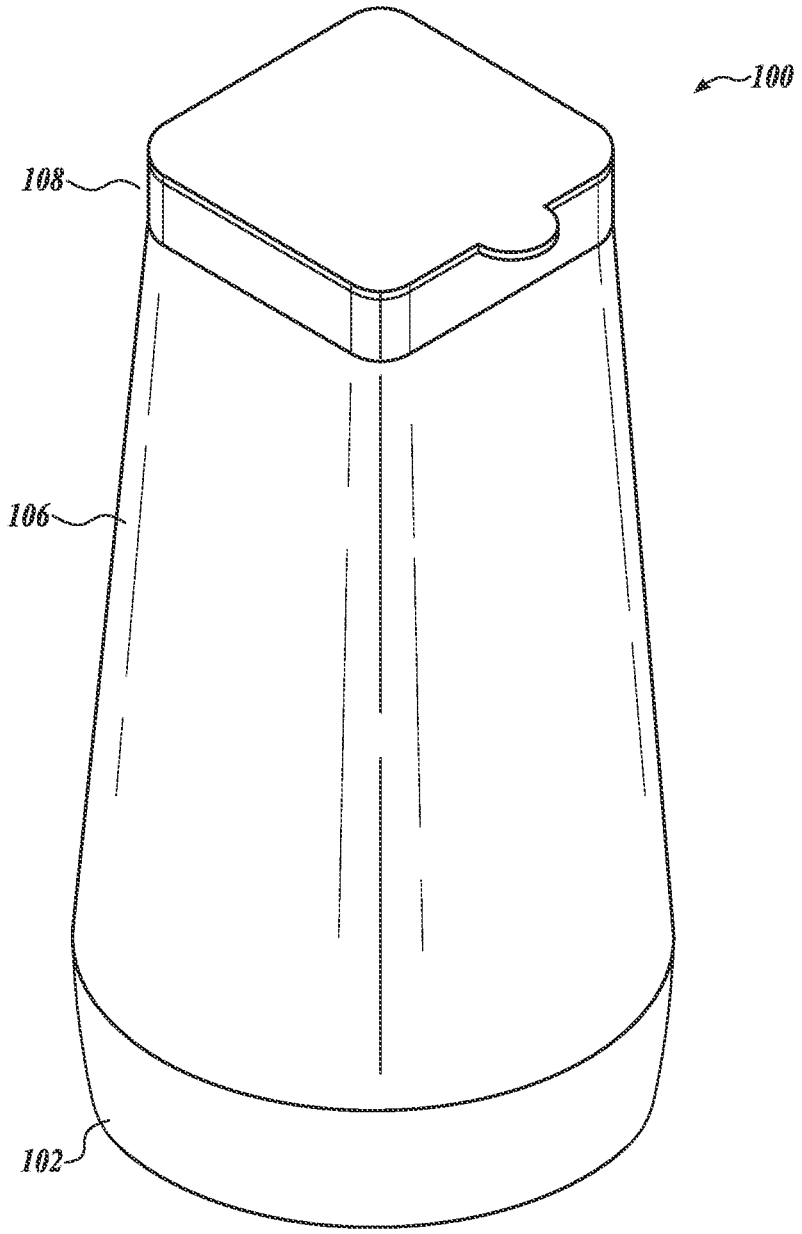
FIG. 1 is an overall perspective view of an example hair care dispensing device, in accordance with the present technology.

While illustrative embodiments have been illustrated and described, it will be appreciated that various changes can be made therein without departing from the spirit and scope of the invention.

The application ("app") disclosed below is configured to work in conjunction with an AI-enabled, motorized cartridge system that creates personalized hair care formulations. In operation, the user may take a photo, or upload a photo, of their hair with a communication device, such as a smartphone camera and open the app on the smartphone. In some embodiments, the app uses AI to analyze the user's hair, including but not limited to the overall hair condition, damage, color, copper content, lice presence, moisture, texture, and/or dandruff. In some embodiments, the app also assesses environmental conditions that can influence the state of the user's hair. Example conditions include, but are not limited to, UV index, air quality, pollen, weather, temperature, and humidity.

In some embodiments, the app also assesses user inputs, including current hair color, past hair treatments, hair length, and hair texture. In some embodiments, the user can select specific hair concerns, such as moisture, curl, texture, UV protection, or color. In some embodiments, the user selection may include a questionnaire, giving the user a set of prompts to respond to in order to determine what products would work best for their specific needs.

In an embodiment, the app provides suggestions based only on the data analyzed in the photo. In an embodiment, the app provides suggestions based on suggestions provided to other users with similar hair features and environmental conditions. In some embodiments, the app creates a regimen of hair care products. In some embodiments, this hair care regimen is a daily recommendation. In other embodiments, this regimen is a weekly or monthly regimen of recommended products.

In some embodiments, a personalized blend of high-performance hair care is then dispensed in a portioned dose at the top of the device, into a dispensing chamber. In some embodiments, this dose is a single dose for a single application. In some embodiments, this is enough doses for a weekly number of applications, such as seven doses for seven days of the week. In some embodiments, one or more hair care blends is dispensed.

With regular use, the AI platform can assess the appearance of a user's hair over time, and the history of a user's hair treatments, helping users identify what is working, and calibrating future formulas. The AI-powered system can optimize the efficacy of personalized formulas. By taking photos regularly, users enable the smart system to recognize the hair care formula's effects and adjust the dosage of active ingredients accordingly. However, in some embodiments, the user can override the system recommendations if they are seeking a specific product.

In an embodiment, the hair care formulations process incorporates real-time trend information as well as color-matching technology, in the case of hair dye and root touch ups, into its personalized product offerings as described below. In some embodiments, a user can create their own custom hair dyes or hair care formulations based on their personal features such as skin tone and eye color. In some embodiments, the dispensing device can dispense hair color along with other hair care materials needed for hair coloring, such as bleach or toner. In some embodiments, the dispensing device can dispense other hair care products, such as shampoo, conditioner, serum, masks, lice treatment, leave-in products, and mousse.

In some embodiments, the dispensing system is configured to accept three cartridges containing hair care material, but in other embodiments, the number of cartridges can be larger or smaller. In some embodiments, the cartridges slide into the dispensing device. In some embodiments, the cartridges click into the dispensing device. In some embodiments, the cartridges may contain one or more active ingredients beneficial for hair care, such as zinc oxide, tea tree oil, etc. In some embodiments, the cartridges are color coded or shaped in a specific manner to allow a user to better distinguish them from one another. In some embodiments, the cartridges are RFID or QR coded so that the dispensing device can determine what hair care material is inside the cartridge.

In some embodiments, the dose of hair care formula is a single dose. In some embodiments, the user can double or triple this dosage with an additional touch. In some embodiments, the dispensing device can prescribe a weekly regimen that the user can receive daily. In some embodiments, the dose of hair care formula is enough hair care formula for the entire weekly regimen. In an embodiment, the cartridge contain one or more hair or scalp treatment formulation. Examples of treatment formulations include permanent hair dye; semi-permanent hair dye; developer; conditioner; hair growth treatment, such as minoxidil manufactured under the trade name ROGAINE®; hair protein treatment; disulfide bond repairing hair treatment, such as OLAPLEX®; fluid hair treatment; fluid scalp treatment, and the like. Although any hair and scalp treatment formulation is suitably applied using the embodiments of the appliance described herein, the present disclosure generally refers to hair coloring formulation as the example of treatment formulation applied by the appliance described below. However, it should be appreciated that any of the listed hair and scalp treatment formulations are interchangeable with the coloring formulation described herein. See e.g., US20190098974 (incorporated herein by reference in full).

In an embodiment, the app generates a user experience based one or more inputs indicative of a hair type; hair or scalp goal; climate, exposome, or geolocation information; air and scalp cleansing, conditioning, and styling regimen, and the like.

In an embodiment, the app generates a user experience based one or more inputs indicative of a scalp condition. Examples of scalp condition include dandruff, dry scalp, irritated skin, oily skin (seborrheic dermatitis), presence of Malassezia, scalp eczema, seborrheic dermatitis, sensitivity to hair care products, and the like In an embodiment, the app generates a user experience based one or more inputs indicative of hair type. Examples of hair type include coily, defined curl or spiral, straight, wavy, and the like In an embodiment, the app generates a user experience based one or more inputs indicative of hair color. Examples of hair color include black, blonde, brown, grey, red, silver, white, and the like.

In an embodiment, the app generates a user experience based one or more inputs indicative of hair state, hair porosity, hair elasticity, hair width, hair health, and the like.

Examples of hair or scalp goals include add shine, body and volume; care for color-treated hair; color your hair; define curls; grow longer stronger hair; hydrate hair; remove buildup; remove oil; smooth hair; treat damage; treat frizz, and the like.

FIG. 1 is an overall perspective view of an example hair care dispensing device 100, in accordance with the present technology. The visible portion of the hair care dispenser 100 includes a base 102. The base 102 provides a support for a dispenser body 106. In some embodiments, the base 102 provides power to the device, such as with an electrical cord (not shown in FIG. 1). A dispensing container 108 is disposed above the dispenser body 106, a power button (not shown in FIG. 1), may be disposed partly within the dispenser body 106 such that the dispenser body 106 secures placement of the power button, and an indicator light and button (not shown in FIG. 1) may be disposed partly within the dispenser body 106 such that the dispenser body 106 secures placement of the indicator light and button. The indicator light and button may be a mechanical or capacitive touch-type button. The dispenser body 106 may provide a base for the dispensing container 108.

Figure 2:
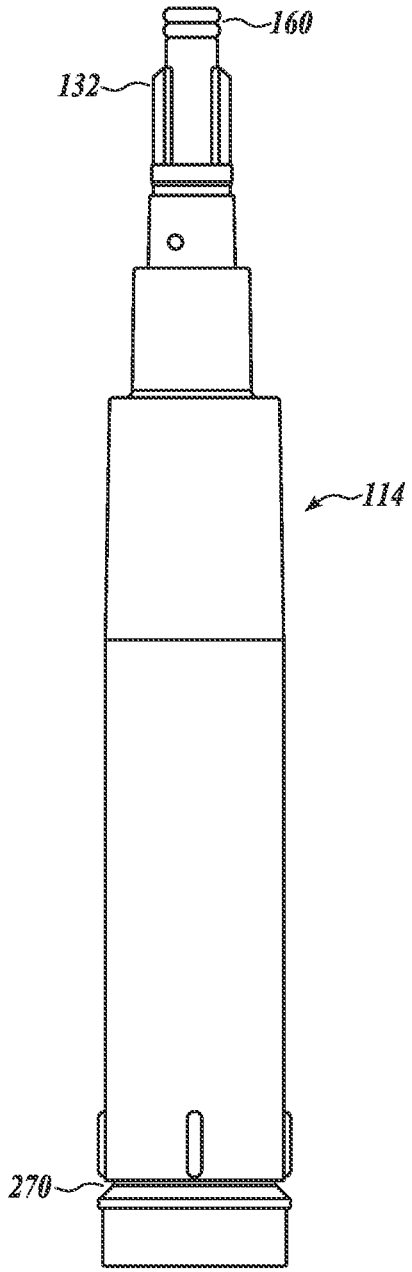
FIG. 2 is an example cartridge, in accordance with the present technology.

FIG. 2 is an example cartridge, in accordance with the present technology. The cartridge 114 has a round, cylindrical body and a nozzle 160 at a first end. The nozzle 160 is further disposed near a cartridge key 132. The cartridge 114 contains and dispenses an amount of hair care material into the dispensing container 108 as needed. In some embodiments, the cartridge 114 dispenses hair care material by rotation of a cartridge gear while the cartridge 114 remains in place substantially vertically along the Y-axis. A circumferential groove 270 is at a second end of the cartridge 130 and is used to secure the cartridge 114 into the dispensing device 100.

An amount of hair care material is released from the cartridge 114 through the nozzle 160 by a first rotational motion of the first end with respect to the second end of the cartridge 114. Rotational motion of the first end of the cartridge 114 in a second direction, opposite of the first rotational motion, may close the nozzle 160 of the cartridge 114.

Figure 3:
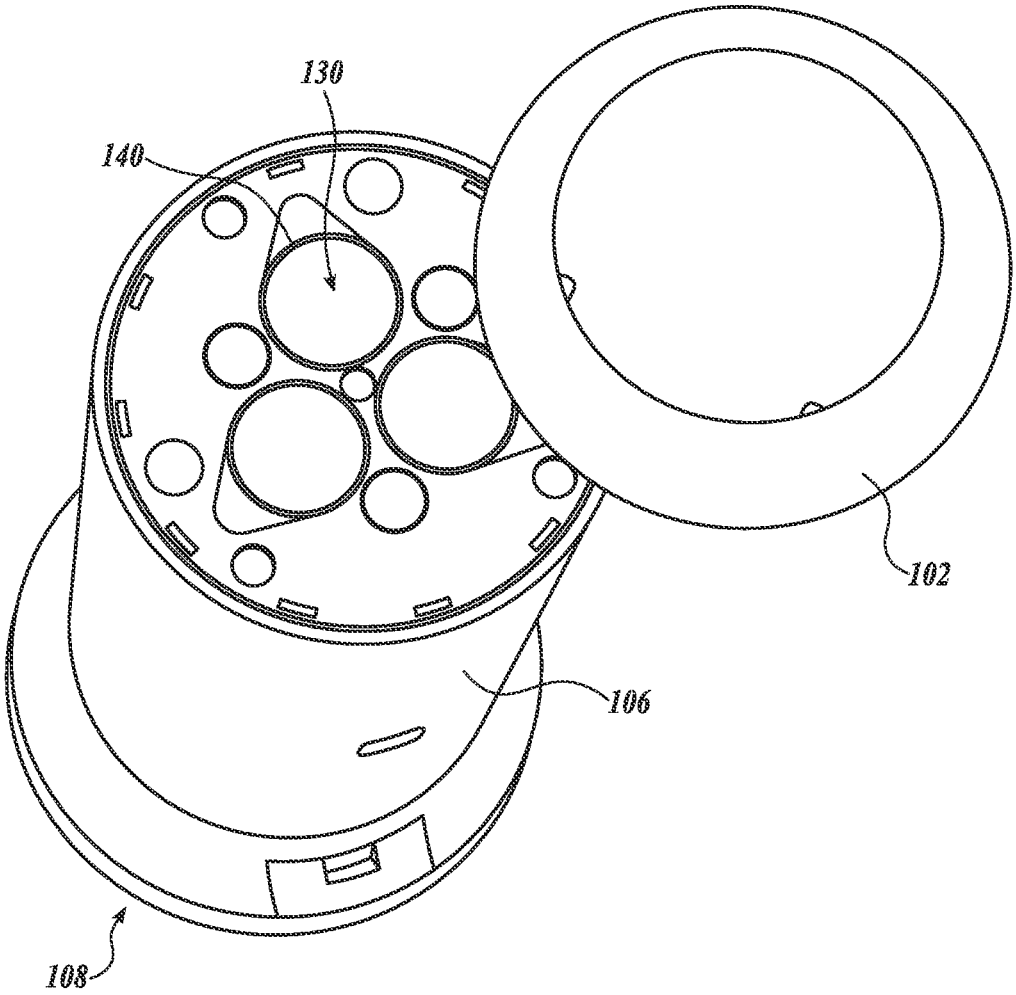
FIG. 3 is a top-down view of an example base of a hair care dispensing device, in accordance with the present technology.

FIG. 3 is a top-down view of an example base of a dispenser device, in accordance with the present technology. In an embodiment, the base 102 is connected to the body 106 of the dispensing device 100 in a manner that allows it to be rotated open to expose a plurality of cartridge openings 140. In some embodiments, the base 102 is removed completely to access the cartridge openings 140. In some embodiments, the base 102 is attached to the body 106 with a hinge, screw, magnet, or other mechanism for attachment. As illustrated, one or more cartridges 130 can be inserted into the plurality of cartridge holes 140. Though three cartridge holes 140 are illustrated in FIG. 3, any number of cartridge holes 140 can be in the body 106 of the dispensing device 100.

A nozzle 160 of each cartridge 114 is disposed inside one of the cartridge holes 140. Various additional substructures and covers may be disposed between the internal components of the hair care dispenser 100 and the dispenser body 106.

Figure 4:
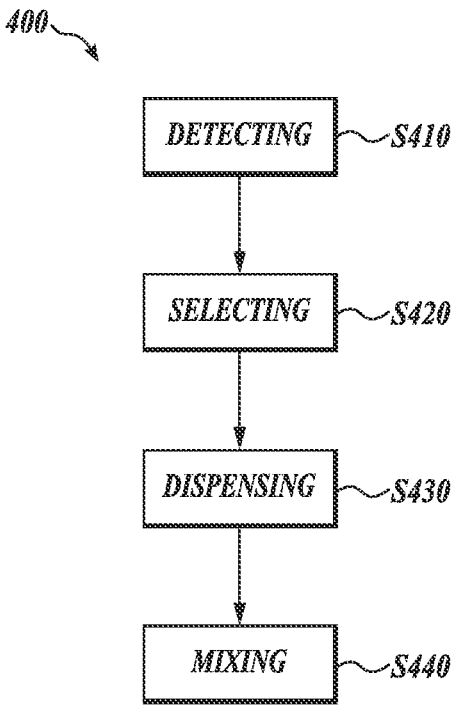
FIG. 4 is a diagram representing an example sequence of primary processes of a hair care formulation method, in accordance with the present technology.

FIG. 4 is a diagram representing an example sequence of primary processes of a hair care formulation method 400, in accordance with the present technology. The examples provided herein each have three cartridges 114, though the same process may be used by hair care dispenser 100 equipped with any number of cartridges 114. The hair care formulation method 400 includes a detecting process S410, a selecting process S420, and a dispensing process S430. An additional mixing process S440 may be performed by a user.

Figure 6:
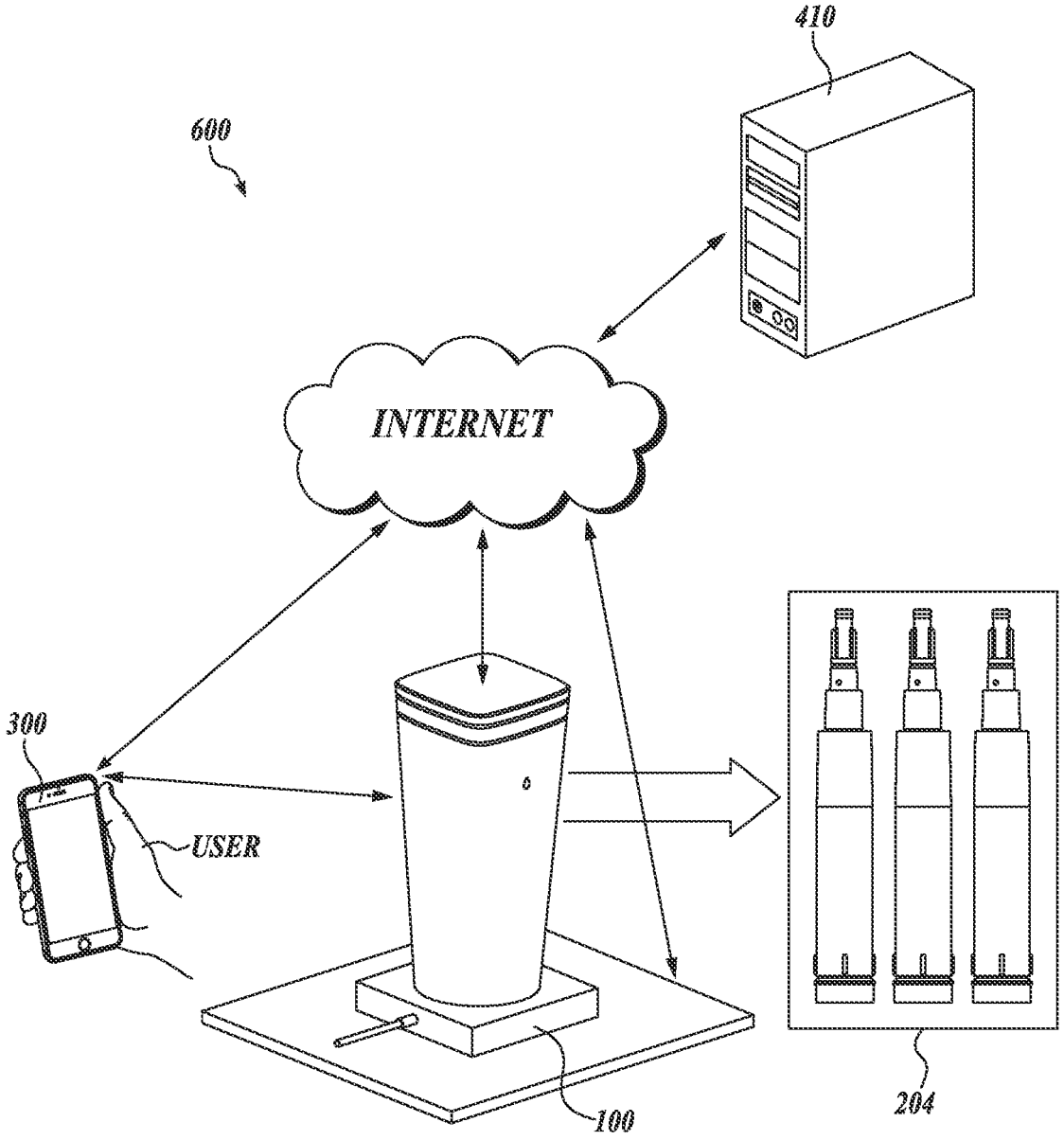
FIG. 6 is a diagram representing an example of a connected hair care dispensing system, in accordance with the present technology.

The detecting processes S410, the selecting process S420, and the dispensing process S430 are performed by the hair care dispensing device 100 based on commands received from a controller, (not shown) the controller sending data to and receiving input from the user through the smart device 300 (as illustrated in FIG. 6) or by indicators on the hair care dispensing device 100 itself.

Figure 5:
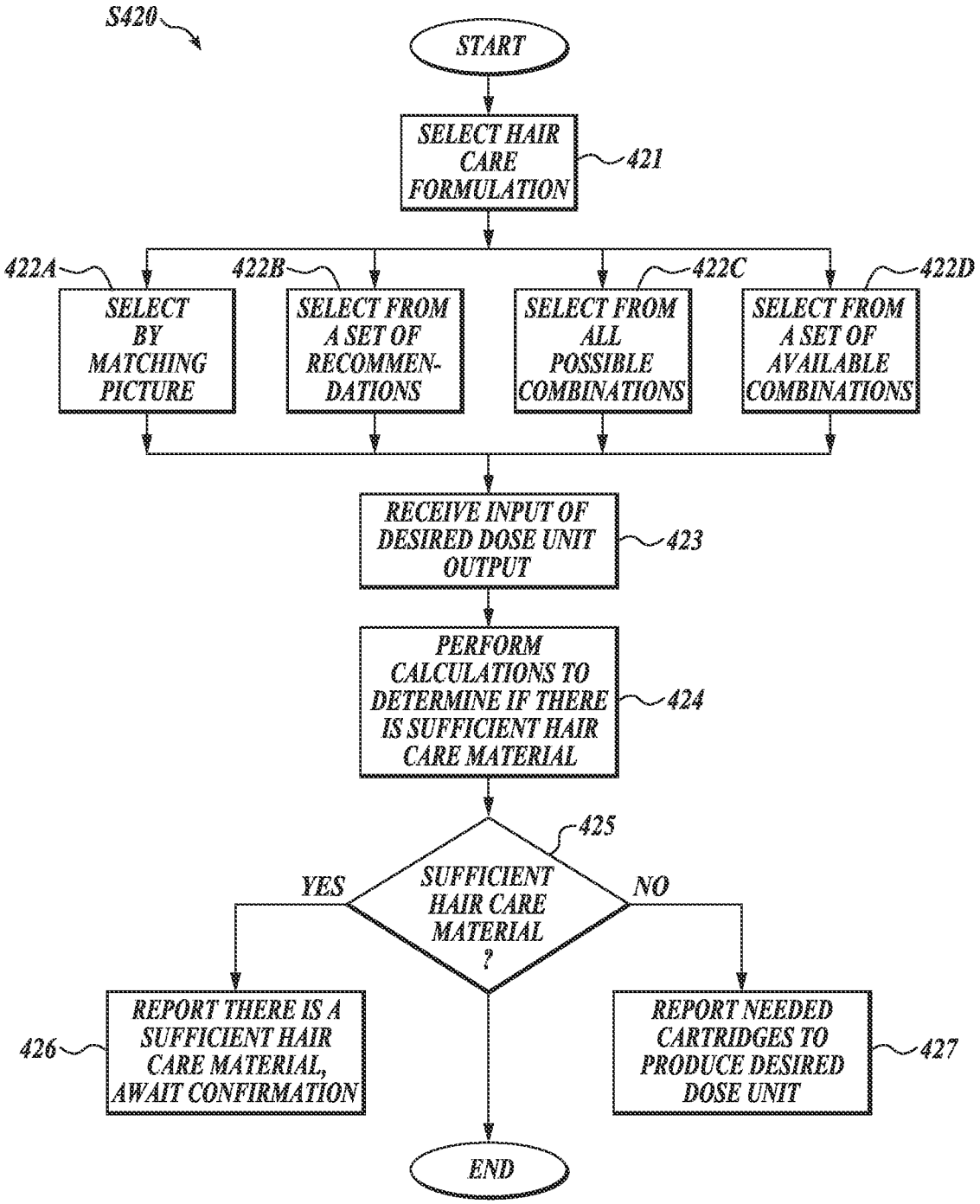
FIG. 5 is a process diagram representing an example a process of selecting a hair care formulation, in accordance with the present technology.

FIG. 5 is a process diagram representing an example of a process S420 of selecting a hair care formulation, in accordance with the present technology. S420 includes a process for selecting a hair care formulation. The process S420 includes steps of identifying the possible combinations of hair care formulations based on the type and quantities of hair care materials present within the hair care dispenser 100, as established by the detecting process S410.

In an embodiment, the process S420 includes a step 422*a* for the user to select a hair care formulation based on matching the color in a photo, a step 422*b* for the user to select a hair care formulation based on recommendations or select a hair care formulation based on another process. U.S. Pat. No. 8,634,640, describes a method for selecting a color from an image or picture in a camera or electronic device, and using color reference data to substantially match the color, and is hereby incorporated as reference in its entirety.

In an embodiment, a step 422*d* is based on a user selecting from a set of hair care formulations that are possible for the types and quantities of hair care material present within the hair care dispenser 100, or a step 422*c* allows the user to choose from a larger set of hair care material inventory 204 that is possible for types and quantities of hair care materials the hair care dispenser 100 is capable of using.

In another example, a step 423 of process S420 includes allowing a user to choose a desired dose unit 118. Varying the dose unit 118 can change the set of available hair care formulations from within the hair care dispenser 100 if a greater amount of one or more hair care materials is needed than is available to dispense a specific quantity of a dose unit 118 for a specific hair care formulation.

For example, in the case of hair color, or root touch up, if cartridge A contains yellow hair care material, cartridge B contains red hair care material, and cartridge C contains green hair care material, and there is only one dose unit 118 of cartridge A remaining, the user would not be able to choose to dispense any combination of dose units 118 and hair care formulation that requires more than one dose unit 118 of yellow hair care material.

In another embodiment, a hair diagnosis (sometimes referred herein as a hair profile) may be performed to provide a recommended plurality of predetermined qualities for the user to select based on an analysis of the user's hair features. The hair diagnosis determines an appropriate hair care formulation for the user based on an imaging operation performed on the user's hair.

For hair care formulations that are possible but not available based on the results of the detecting process S410, the hair care dispenser 100 may communicate to the user what hair care materials are necessary to dispense such hair care formulations.

In one example, in step 424 the user selects a dose unit 118 of a hair care formulation presently unavailable. Step 424 may determine what hair care materials, such as what type of cartridges 114 are needed to mix and dispense the selected hair care formulation.

In another example, step 424 may determine what additional hair care formulations may become available if a specific cartridge 114 is replaced with a full but otherwise identical cartridge 114. In another example, step 424 may determine what additional hair care formulations may become available if a cartridge 114 is replaced with another cartridge 114 containing different hair care material.

Step 425 determines whether to proceed to step 426 to prompt the user to confirm and proceed with dispensing a hair care formulation or to proceed to step 427 to report what cartridge or cartridges 114 are needed to dispense the desired cosmetic formulation, based on the outcome of step 425.

After the dispensing process S430 is completed, the user may perform the process S440 of mixing the released cosmetic material manually, producing the requested hair care formulation.

FIG. 6 is a diagram representing an example of a connected hair care dispensing system, in accordance with the present technology. A system 600, which implements the hair care dispenser 100 described above, includes at least the hair care dispenser 100 and a connected communication device 300. Optionally, the system may further include one or more external servers 410 which are implemented as part of a cloud-computing environment. Furthermore, the system may optionally include a hair care material inventory 204 which is an inventory of possible hair care material that may be inserted into the hair care device 100.

The connected device 300 may be a personal computer (PC), a laptop computer, a PDA (Personal Digital Assistants), a smart phone, a tablet device, a UMPC (Ultra Mobile Personal Computer), a net-book, or a notebook type personal computer. In the below examples, the connected device 300 is assumed to be a tablet device, such as an Apple iPad.

The connected communication device 300 is capable of performing wireless communication with the hair care dispenser 100 by way of a wireless communication interface circuitry on the hair care dispenser 100. However, communication device 300 is also capable of having a wired connection to the hair care dispenser 100 by way of a USB interface on the apparatus 100. Additionally, each device, including the hair care dispenser 100, may communicate with each other and the external one or more devices through an internet connection via an 802.11 wireless connection to a wireless internet access point, or a physical connection to the internet access point, such as through an Ethernet interface. Each connected communication device 300 is capable of performing wireless communication with other devices, such as through a Bluetooth connection or other wireless means as well.

The connected communication device 300 is configured to receive information from a user for use in generating a hair care formulation that will be used by the hair care dispenser 100 to dispense hair care material into a dispensing container 108.

Figure 7:
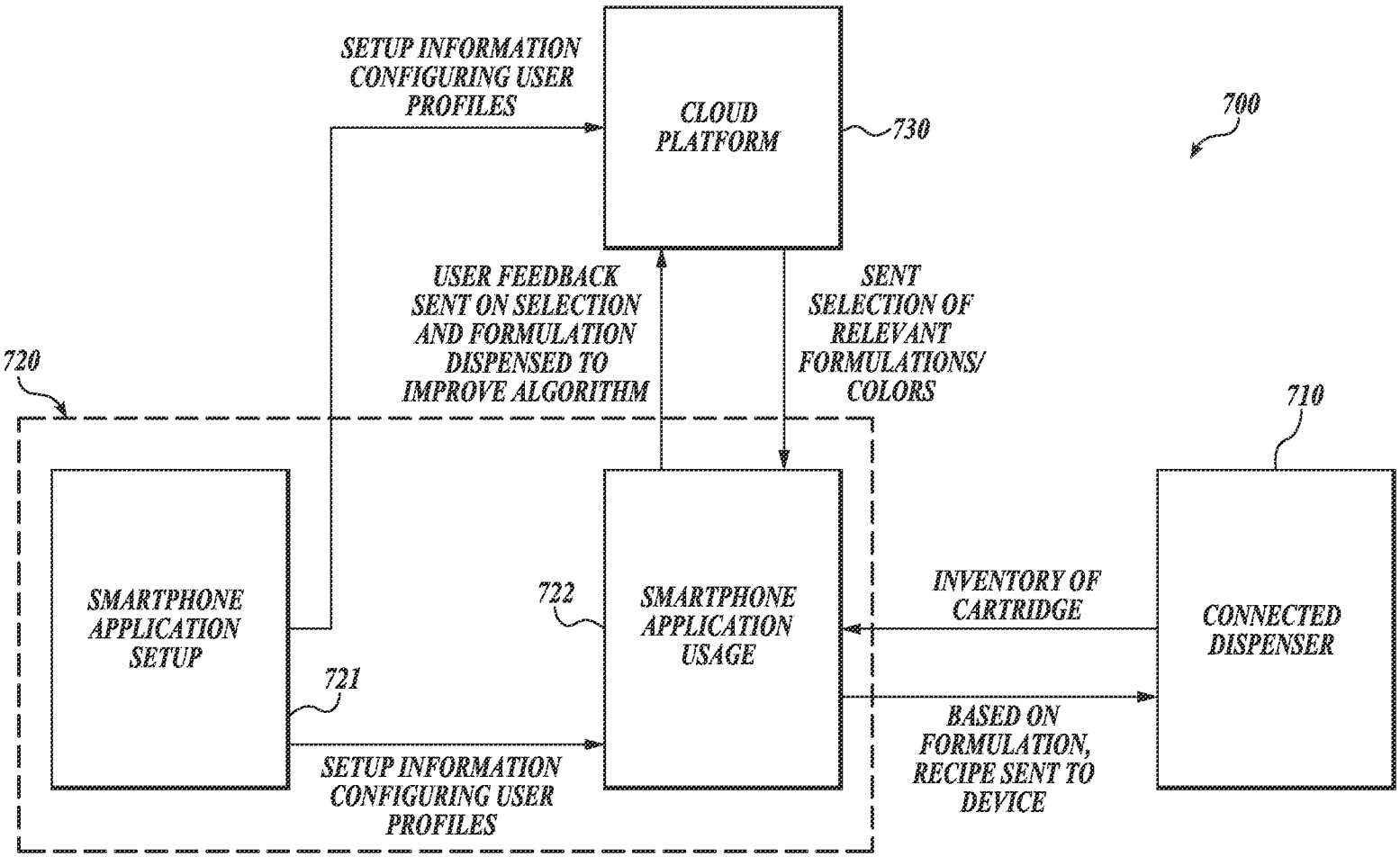
FIG. 7 is an example system for dispensing hair care formulations, in accordance with the present technology.

FIG. 7 is an example system 700 for dispensing hair care formulations in accordance with the present technology. The system 700 includes the dispenser 710 (such as cosmetic dispenser 100), a user smartphone device 720 (such as communication device 300), and a cloud platform 730. The smartphone is shown to include two functional blocks of the smartphone application ("app") setup 721 and the smartphone app usage 722. The smartphone app setup 721 involves establishing the initial setup information for configuring a user profile of the user, as described below. The setup information can then be utilized when the smartphone application is being used and can also be sent to the cloud platform 730 for use in sending a selection of relevant looks for the user.

Usage of the smartphone application itself may include the user actually making selections that lead to the determination of a color, quality, or amount, of hair care material and performing interactive communication with the dispenser, such as sending the recipe to the dispenser and tracking the status of the dispenser (such as inventory and remaining volume of the cartridges in the dispenser). The smartphone application also performs interactive communication with the cloud platform. For instance, the smartphone application can receive the selection of relevant looks as described above, provide direct user feedback from the user on the looks the cloud platform previously sent, and notify the cloud platform on the colors and recipes actually selected by the user and dispensed by the dispenser. Such feedback can provide a form of machine learning to the cloud platform and improve the algorithms used by the cloud platform.

Figure 8:
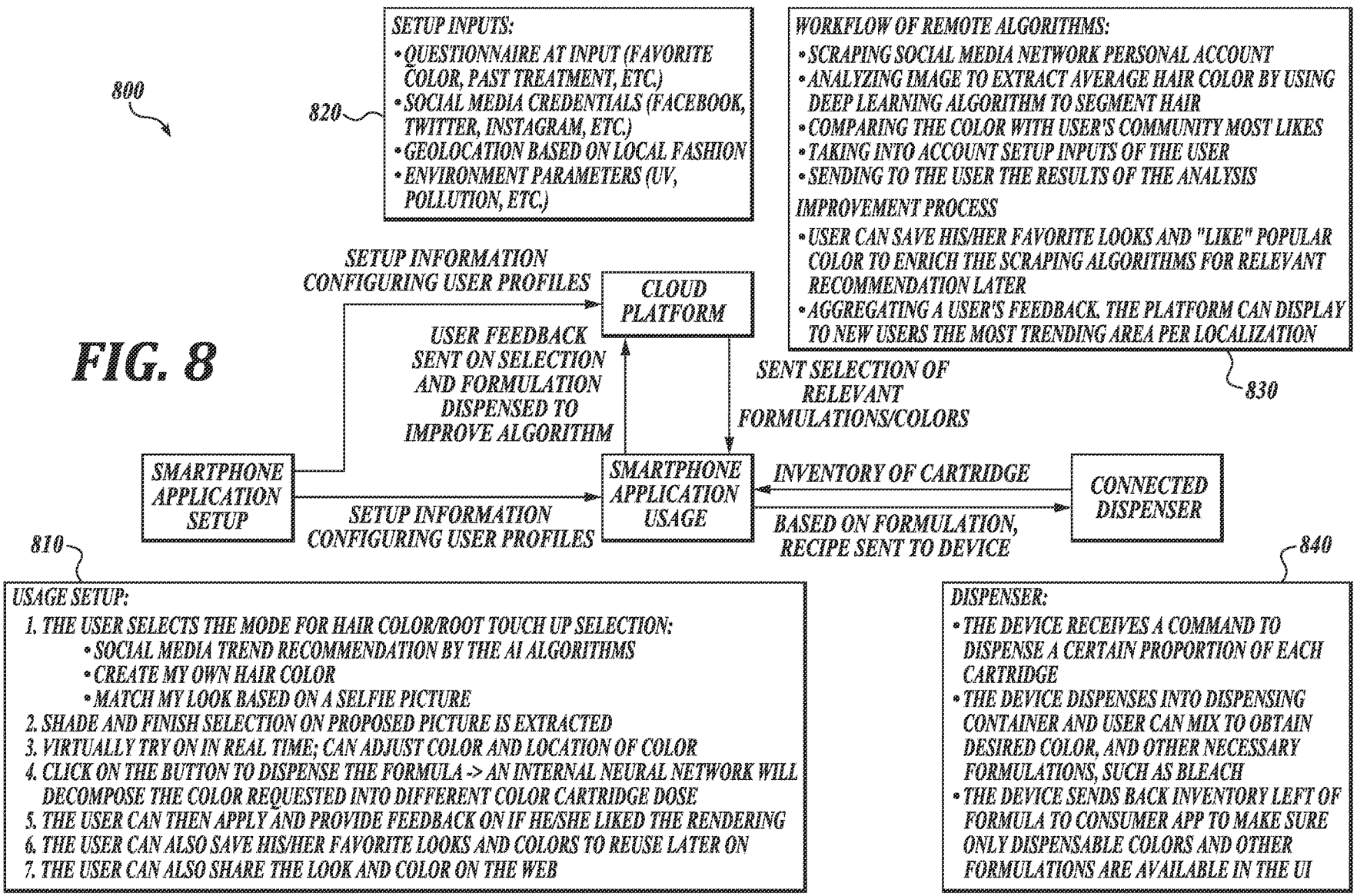
FIG. 8 is an example system for dispensing hair color, in accordance with the present technology

FIG. 8 is an example system 800 for dispensing hair color in accordance with the present technology. In some embodiments, the example system can also dispense hair color for root touch-ups, and hair care materials associated with hair color, such as bleach and toner.

In some embodiments, the system proposes a trending hair color to the consumer after having analyzed trends on social media by combining favorite colors, taste, geolocation, favorite influencers, past selection, likes . . . etc. In some embodiments, the user can pick a color based on a look, virtually try it and adjust it if necessary to produce the formula on the spot with a connected dispenser (such as hair care dispenser 100). It is also possible to propose a color based on the user's outfit digitalized with a selfie picture. The consumer can save their favorite colors and share it with their virtual community. In some embodiments, the user can save past dispensed colors to continue to color their hair to that desired shade.

In operation, a user smartphone ultimately delivers a recipe to the dispensing device via a smartphone application ("app"). The smartphone app interacts with both the connected dispenser and a cloud platform. Prior to a user performing normal operations (usage) of the smartphone app, the app needs to be setup 820 with setup information for configuring a user profile. The app setup can be based on the following multiple setup inputs including a questionnaire at onboarding (such as favorite color, past color treatments, length of hair, texture of hair, etc.), social media credentials (like Instagram, twitter, Facebook, TikTok, etc.), favorite influencers to suggest similar hair colors, geolocation to determine local fashion, and environment data (UV index, pollution, humidity, pollen).

The setup inputs are used during regular usage of the app on the smartphone, but they are also transmitted to a cloud platform, which may be an external server device that is connected via the Internet.

The actual usage of the smartphone app 810 includes selecting a mode for hair color selection. In the present example, the modes include a mode for selecting a social media trend recommendation by algorithms that are executed in the cloud platform (discussed below in more detail). Another mode allows the user to create their own hair color using a wide variety of color options.

Another mode may allow the user to match a hair color to their "look" based on a selfie picture. In this example, the shade and finish selection in the photo is extracted. The user can virtually try on the hair color in real time and adjust the color presented. In some embodiments, the user can decide whether or not they would like to additionally dispense other formulations for dying their hair, such as bleach or toner.

After the recipe is sent to the dispenser and the hair color shade is dispensed, the user can apply the hair color. In some embodiments, the app provides instructions on using the products in the most effective manner.

Following use of the hair color, the user can use the app to provide a feedback if she/he liked the rendering or not. The user can also save her favorite look and color to reuse later on, and the user can share the look and color on the web via a social media platform. Additionally, the user can save the fact and the date that they colored their hair so that the application can remind the user to touch-up their roots, re-dye their hair, or recommend colored-hair specific products such as color-safe shampoo and conditioner.

The cloud platform implements functions shown in 830, such as a workflow of remote algorithms and an improvement process.

In the workflow performed by the cloud platform, social media network personal accounts (influencers, most trending looks, etc.) may be scraped for data related to hair colors. The cloud platform may then perform comparisons of an extracted color with colors most liked by one or more communities of users while also taking into account the setup inputs of the user received from the user's smartphone device. Taking into account all of the collected data, the final step is for the cloud platform to send to the user the results of the analysis in the form of the above-noted selection of relevant looks. In some embodiments, the application can analyze these inputs and ensure there are no adverse reactions from these products being mixed will occur. In some embodiments, the application may analyze the photo of the user's hair to ensure the products will not have an adverse effect with the user's hair. In some embodiments, the application may alert the user as to the feasibility of achieving their desired hair color (such as alerting the user that it may take multiple hair color treatments to go from black hair to blonde hair).

In the improvement process performed by the cloud platform and the smartphone app, the user can save his or her favorites looks and "like" popular colors to enrich the scraping algorithms for a relevant recommendation at a later time. The cloud platform can further aggregate the users' feedback, and the platform can send to new users the most trending colors in their area.

The dispenser operations in block 840 are already described above, but they are summarized as follows. The dispenser receives a command to dispense a certain proportion of each cartridge. The dispenser dispenses into a dispensing container (such as dispensing container 108) and the user can mix it to obtain the desired color. In some embodiments, the dispenser can dispense other hair care formulations for helping to dye the user's hair, such as bleach or toner. In some embodiments, the hair care formulations are dispensed separately, one formulation after the other. In some embodiments, the hair care formulations are dispensed simultaneously. The dispenser sends back inventory left of formula to the consumer app to make sure only dispensable colors are available in the UI when the user makes a selection.

Figure 9:
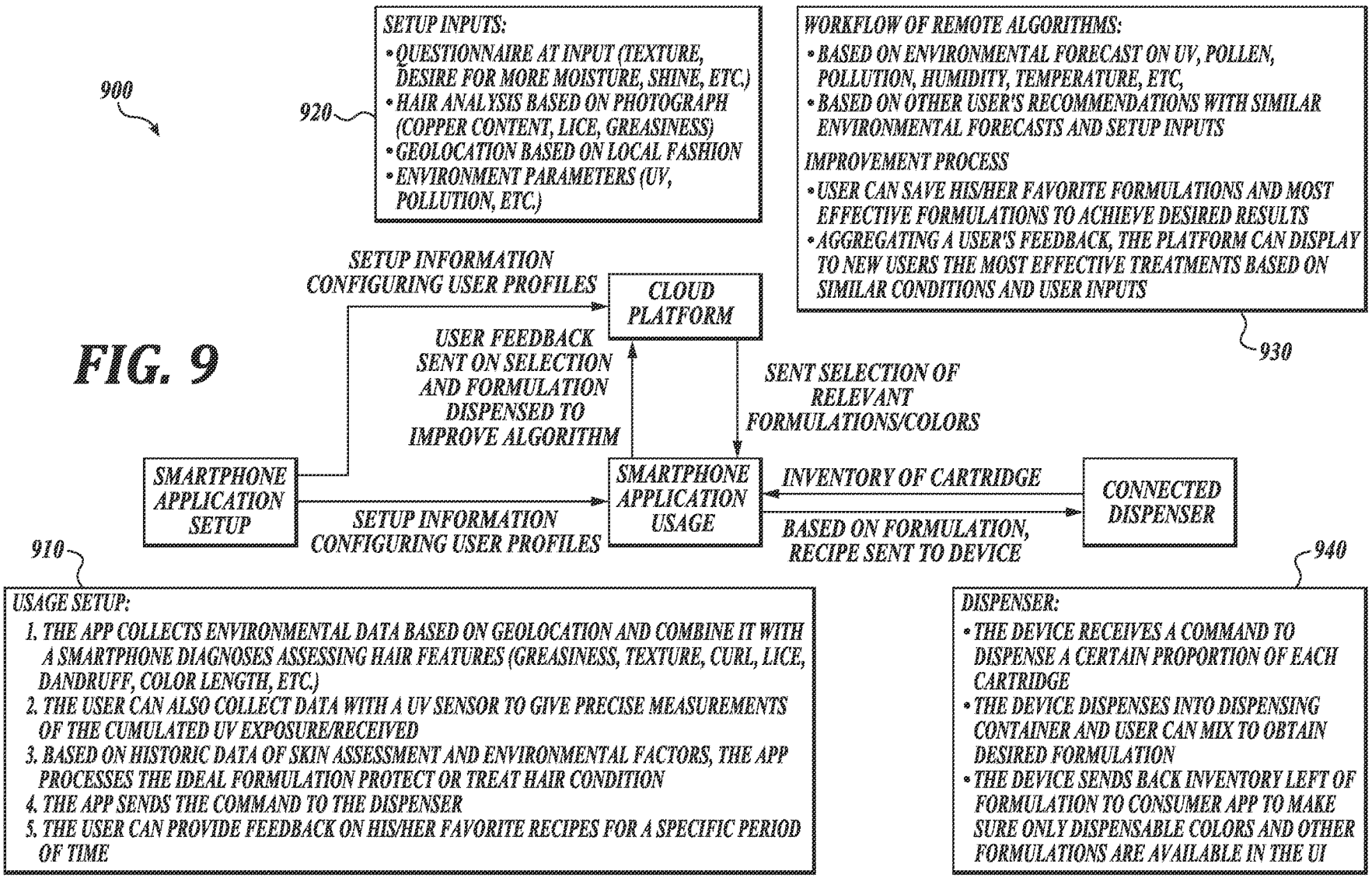
FIG. 9 is an example system for dispensing hair formulations, in accordance with the present technology.
Figure 10:
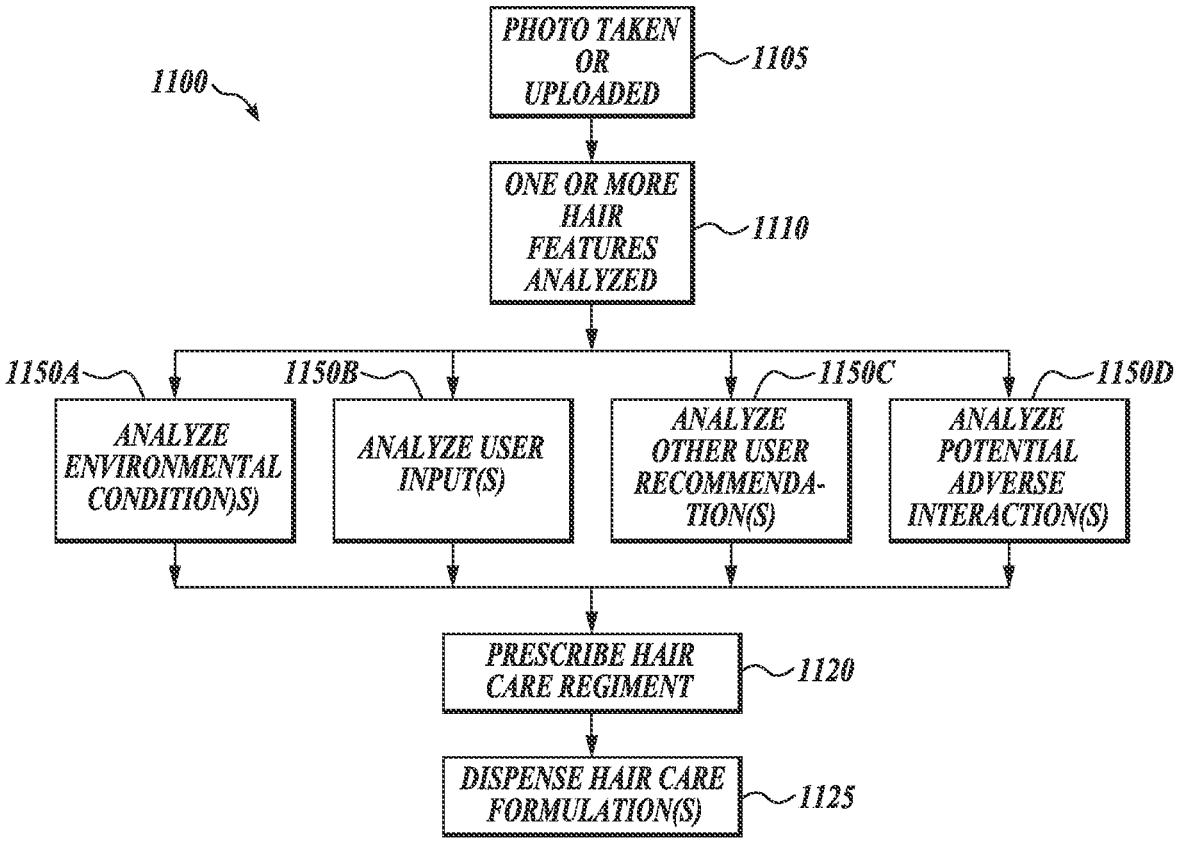
FIG. 10 is an example system for dispensing hair formulations, in accordance with the present technology.

FIG. 9 is an example system 900 for proposing hair formulations to the user, in accordance with the present technology. The system illustrated in FIG. 9 may prescribe the most effective hair care formulation for the user based on the user's geolocation, environmental factors, personal preferences, desired results, UV exposure, and hair features or hair diagnosis assessed with a smartphone. In some embodiments, the system manages to adjust the proportions of active ingredients to obtain the most effective recipe on a daily basis. In some embodiments, the system prescribes a hair care regimen. In some embodiments, the hair care regimen is a daily regimen. In some embodiments, the hair care regimen is a weekly regimen (as shown in FIG. 10). The user can save their favorite formulations and share them with his/her virtual community.

In operation, a user's smartphone ultimately delivers a recipe to the dispensing device via a smartphone app. The smartphone app interacts with both the connected dispenser and a cloud platform. Prior to a user performing normal operations (usage) of the smartphone app, the app needs to be setup 910 with setup information for configuring a user profile. The app setup can be based on one or more setup inputs, including a questionnaire at onboarding (such as desired hair quality, hair length, previous hair treatments, hair concerns, etc.), hair care analysis by a hairstylist or by AI algorithms with a selfie, geolocation based on smartphone location detection function, and/or environment data (UV index, pollution, humidity, pollen, etc.).

The setup inputs are used during regular usage of the app on the smartphone, but they are also transmitted to a cloud platform, which may be an external server device that is connected via the Internet.

The actual usage of the smartphone app 920 includes collecting environmental data based on geolocation and combining it with a smartphone diagnosis assessing hair features (greasiness, gray hair, lack of shine, lice, dandruff, etc.).

In some embodiments, the user can also collect data of a UV sensor, such as a wearable UV sensor as described in U.S. Pat. No. 10,060,787, incorporated herein by reference, that will give precise measurement of the cumulated UV exposure received. Based on historical data of hair assessments and environmental factors, the app will process the ideal formulation to protect a user's hair from overexposure to UV radiation.

In some embodiments, the app compares the user's input and the environmental factors around the user and recommends a hair care formulation or formulations based on the choices by users with similar hair features, desired results, and environmental conditions. In some embodiments, the app ensures there will be no adverse reactions between the recommended products and the user's hair. In some embodiments, the app ensures there will be no adverse reactions between the recommended products themselves.

When the user is satisfied with the formulation, the user can touch a button displayed on the app to dispense the formulation and an internal neural network will decompose the formulation requested into different cartridge ingredients. After the recipe is sent to the dispenser and the formulation is dispensed, the user can apply the formulation. The user can provide feedback on their favorite formulations for a specific period of time.

The cloud platform implements functions shown in 930, such as a workflow of remote algorithms and an improvement process. In the workflow performed by the cloud platform, based on environmental forecast on UV, pollen, pollution, temperature, specific notifications are sent to the app user to adjust the recipe. Additionally, given an input of the geolocation of the user, which can provide an air quality determination using a tool such as Breezometer™ and a local UV index forecast (or UV exposure obtained based on a UV sensor as described above), the cloud platform can adjust the recipe to address environmental factors such as UV exposure and air quality.

In the improvement process performed by the cloud platform and the smartphone app, the user can save their favorites recipes that are the most effective overtime or achieve the user's desired results. The user can also share with the community their recipes.

The cloud platform can further aggregate all of the users' feedback, and the cloud platform can send to new users the most trending formulizations in their area. In some embodiments, the cloud platform can send recommendations to other users with similar hair features in the same general locality.

The dispenser operations in block 940 are already described above, but they are summarized as follows. The dispenser receives a command to dispense a certain proportion of each cartridge. The dispenser dispenses on the top part and user can mix it to obtain the desired formulation. Finally, the dispenser sends back the inventory left of formula to the consumer app to make sure only dispensable ingredients are available in the UI when the user makes a selection.

FIG. 10 is an example method 1100 for dispensing hair formulations, in accordance with the present technology. The method 1100 begins in block 1105.

In block 1105, a photo is taken or uploaded. In some embodiments, the photo is uploaded onto an application. In some embodiments, the application is configured to access a user's camera to take the photo. The method 1100 then proceeds to block 1110.

In block 1110, one or more hair features is analyzed. The hair features may include any number of hair features, including any as described herein. Example hair features may include color, shine, greasiness, smoothness, frizz, dandruff, and the like. The method 1110 then proceeds to blocks 1150A, 1150B, 1150C, and 1150D.

In block 1150A, environmental conditions are analyzed, as described herein. Environmental conditions may include UV spectrum, temperature, humidity, location, and the like. In block 1150B, user inputs, such as user inputs described herein, are analyzed. In some embodiments, user inputs include, but are not limited to, day of hair coloring, desired hair quality, special events, or the like. In block 1150C, user recommendations are analyzed. In some embodiments, user recommendations include recommendations made by users located in the same place, having the same hair quality, having the same environmental conditions, and the like. In block 1150D, potential adverse interactions are analyzed. In some embodiments, this includes determining whether any products in the hair care regimen may interact with each other negatively, such as bleach and shampoo. It should be understood that blocks 1150A-1150B may occur simultaneously or sequentially. In some embodiments, any of blocks 1150A-1150D may be omitted. The method 1110 then proceeds to block 1120.

In block 1120, a hair care regimen is prescribed (such as hair care regimen 1200 in FIG. 11). The method then proceeds to block 1125.

In block 1125, the hair care formula or formulations are dispensed. In some embodiments, a user can actuate the device each time they wish to dispense one or more of the hair care formulas prescribed in the hair care regimen. In some embodiments, the dispensing device automatically dispenses the hair care formulas based on the hair care regimen.

FIG. 11 is an example hair care regimen 1200 as prescribed by a hair care dispensing system, in accordance with the present technology.

In some embodiments, the app recommends a hair care regimen to a user based on their previous hair treatments, hair features, and environmental conditions. A weekly regimen is illustrated, but the prescribed regimen 1200 may be of any length, such as daily or monthly.

In some embodiments, the app can use the knowledge of a user's past treatment or use of the dispensing device to inform the regimen 1200. In some embodiments, the app can use environmental conditions of a user, such as pollution, UV exposure, and pollen. In some embodiments, the app can use hair features (such as color, texture, or length) or a hair diagnosis of the user (such as lice, greasiness, or dandruff) to inform the regimen. In some embodiments, the app can use user preferences (such as number of weekly showers or preferred products of a user). In some embodiments, the app can recommend a regimen based on a regimen for another user with similar hair features, environmental factors, and/or preferences. In some embodiments, the app can use known product recommendations and time frames of the product to inform the regimen (such as the recommendation by a manufacturer to use a hair mask in lieu of conditioner twice a week). In some embodiments, the app can use calendar data and user inputs relating to specific dates (such as a date night on a specific Friday) to inform the regimen (i.e. by prescribing a hair mask the night before, or a hair gel for styling the day of). In some embodiments, the potential for adverse reactions between the hair care products themselves, or the hair care products and the user's hair is used to inform the regimen. In some embodiments, the app can use a combination of some or all of the described methods to create a regimen. In some embodiments, the hair care formulations are dispensed daily. In some embodiments, the hair care formulations are dispensed for the entire regimen, i.e. enough doses for the week, month, etc.

In the example illustrated in FIG. 11, an example weekly regimen 1100 has been prescribed to a user. On Monday, the user dispenses hair color, along with toner and bleach to assist in the coloring. In some embodiments, the user can inform the app that they have applied the hair color, so the app may prescribe touch-ups to the user's dyed hair, such as shown on Sunday of the example regimen.

On Tuesday, the application prescribes color protecting shampoo and conditioner. In some embodiments, the app can use the user's dispensing and application of hair color to inform the regimen. In some embodiments, the app can use the user's saved preference to recommend color protecting shampoo and conditioner.

On Wednesday, the app does not prescribe any products. In some embodiments, this may be based on a user's preferences. In some embodiments, this may be based on recommendations from a manufacturer (i.e. a specific color protecting shampoo prescribed should only be used three times a week).

On Thursday, the app prescribes a color protecting shampoo and a hair mask. Again, this may be done based on a recommendation by the manufacturer or the personal preference of the user. In some embodiments, the recommendation of the hair mask may be based on the lack of adverse reactions between the color protecting shampoo prescribed and the specific hair mask.

On Sunday, a root touch up formula is prescribed. This may also be recommended based on a recommendation from a manufacturer or the personal preference of the user.

In some embodiments, a regimen may be prescribed based on environmental factors. For example, the app may recommend a hair care formulation with zinc oxide when environmental sensors detect a certain amount of UV exposure to the user based on their location.

In some embodiments, the regimen may be prescribed based on other user's with similar hair features and environmental conditions. For example, the app may prescribe a hair care formulation with zinc oxide based on the preference of another user living in the same general location.

The embodiments of the invention in which an exclusive property or privilege is claimed are defined as follows:

1. A system for dispensing hair color, comprising:
one or more cartridges containing one or more hair colors;
a communication device that includes processing circuitry
configured to take a photo of a user's hair;
upload the photo into an application on a communication device;
apply an algorithm to the photo to detect one or more hair features;
analyze trends on one or more social media platforms;
sense one or more environmental conditions with one or more sensors;
recommend a hair color based on the trends analyzed and the one or more environmental conditions sensed; and
a dispensing device configured to dispense one or more hair colors from the one or more cartridges based on the hair care treatment regimen.

2. The system of claim 1, wherein the processing circuitry is further configured to set up a user profile.

3. The system of claim 2, wherein setting up the user's profile comprises answering a user questionnaire, wherein the user questionnaire gives the user a series of inputs, and wherein the series of inputs include past hair treatment, hair length, hair texture, desired hair color, current hair color, and desired permanence of hair color.

4. The system of claim 2, wherein the processing circuitry is further configured to recommend one or more hair care formulations in addition to the hair color for assisting the user in dying their hair.

5. The system of claim 4, wherein the processing circuitry is further configured to analyze the one or more hair care formulations and the one or more hair care features to ensure there are no adverse interactions between the one or more hair care formulations, the hair color, and the user's hair.

6. The system of claim 4, wherein the processing circuitry is further configured to accept user feedback of the user's favorite dispensed hair color to improve the algorithm.

7. The system of claim 4, wherein the processing circuitry is further configured to share the hair color with other users in the same localization.

8. The system claim 4, wherein the processing circuitry is further configured to allow a user to virtually try on the hair color in real time.

9. The system of claim 8, wherein virtually trying on hair color further comprises adjusting the color presented.

10. A method of providing a hair color with the system of claim 1, the method comprising:
taking a photo of a user's hair;
uploading the photo into an application on a communication device;
analyzing trends on one or more social media platforms;
sensing one or more environmental conditions with one or more sensors;
recommending a hair color based on the trends analyzed and the one or more environmental conditions sensed; and
dispensing one or more hair colors.

11. The method of claim 10, wherein the method further comprises recommending a hair care regimen of one or more hair care formulations in addition to the hair color for assisting the user in dying their hair.

12. The method of claim 11, wherein recommending the hair regimen comprises analyzing the one or more hair care formulations and to ensure there are no adverse interactions between the one or more hair care formulations, the hair color, and the user's hair.

13. The method of claim 11, wherein the method further comprises accepting user feedback of the user's favorite dispensed hair color to improve the recommending of the hair regimen.

14. The method of claim 10, wherein the method further comprises sharing the hair color with other users in the same localization.

15. The method of claim 10, the method further comprising saving the date the hair color was dispensed, and sending a reminder for touching up roots, re-dying hair, or recommending one or more colored-hair specific products based on the date the hair color was dispensed.

16. The method of claim 10, the method further comprising virtually trying on the hair color in real time.

17. The method of claim 16, wherein virtually trying on hair color further comprises adjusting the color presented.

18. The method of claim 10, wherein the method further comprises setting up a user profile.

19. The method of claim 18, wherein setting up the user's profile comprises answering a user questionnaire, wherein the user questionnaire gives the user a series of inputs, and wherein the series of inputs include past hair treatment, hair length, hair texture, desired hair color, current hair color, and desired permanence of hair color.

20. The method claim 10, wherein the method further comprises recommending one or more hair care formulations in addition to the hair color for assisting the user in dying their hair.

* * * * *